US007066087B2

(12) United States Patent
Fukui et al.

(10) Patent No.: US 7,066,087 B2
(45) Date of Patent: Jun. 27, 2006

(54) DAMPENING WATER FEEDING METHOD AND PRINTING MACHINE

(75) Inventors: Kazuki Fukui, Kyoto (JP); Takaharu Yamamoto, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 86 days.

(21) Appl. No.: 10/972,522

(22) Filed: Oct. 26, 2004

(65) Prior Publication Data

US 2005/0087085 A1 Apr. 28, 2005

(30) Foreign Application Priority Data

Oct. 27, 2003 (JP) ..... 2003-365637

(51) Int. Cl.
*B41L 25/00* (2006.01)

(52) U.S. Cl. ..... 101/147; 101/451; 101/484

(58) Field of Classification Search ..... None
See application file for complete search history.

(56) References Cited

U.S. PATENT DOCUMENTS 5,341,734 A * 8/1994 Jeschke et al. ..... 101/148
5,592,880 A * 1/1997 Rodi ..... 101/450.1
6,138,563 A * 10/2000 Sone et al. ..... 101/147
6,601,512 B1 * 8/2003 Yamamoto et al. ..... 101/484
6,796,227 B1 * 9/2004 Miller ..... 101/147
2003/0047093 A1 3/2003 Callahan et al.

FOREIGN PATENT DOCUMENTS

EP 1 245 388 A1 10/2002

* cited by examiner

*Primary Examiner*—Andrew H. Hirshfeld
*Assistant Examiner*—Jill E. Culler
(74) *Attorney, Agent, or Firm*—McDermott Will & Emery LLP

(57) ABSTRACT

Densities of detecting patches also called control scales printed on prints in a first print job are used to control the feed rate of dampening water in a second print job following the first print job. Specifically, densities of detecting patches on the prints obtained from the first print job are measured, and a feed rate of dampening water is calculated from the densities of the detecting patches. A base feed rate of dampening water is calculated based on the feed rate calculated and a humidity and temperature occurring when the first print job is performed. A proper feed rate of dampening water is calculated based on the base feed rate and a humidity and temperature occurring when the second print job is performed.

10 Claims, 9 Drawing Sheets

DAMPENING WATER FEEDING METHOD AND PRINTING MACHINE

BACKGROUND OF THE INVENTION

1. Field of the Invention

This invention relates to a dampening water feeding method and a printing machine.

2. Description of the Related Art

In a printing machine, the feed rate of dampening water, as does the feed rate of ink, has a decisive influence on printing results. It is therefore necessary for the printing machine to adjust the feed rate of dampening water as well as the feed rate of ink properly.

To execute a method of automatically detecting the quantity of dampening water and controlling the feed rate thereof, an apparatus has been proposed that measures a film thickness of water on a roller by using an infrared sensor, for example. However, such an apparatus has difficulties in coping with environmental changes occurring in time of printing, and the apparatus itself is extremely expensive.

Then, in Japanese Unexamined Patent Publication No. 2002-355950, Applicants herein have proposed a method of controlling feeding rates of dampening water and ink in a printing machine by using first and second detecting patches presenting a difference in density variations after printing with varied feed rates of damping water and ink. The method of controlling feeding rates of dampening water and ink in a printing machine described in the above publication is capable of adjusting the feed rates of dampening water and ink properly.

A feed rate of dampening water required when starting a printing operation is dependent on the printing environment existent at that time. In practice, therefore, when starting a printing operation, the operator adjusts a feed rate of dampening water determined beforehand by computation, according to the printing environment occurring at that time. However, the experience of the operator may not be adequate to set a proper feed rate of dampening water easily at start of a printing operation, and may use a wasteful amount of printing paper.

SUMMARY OF THE INVENTION

The object of this invention, therefore, is to provide a dampening water feeding method and a printing machine capable of feeding dampening water in a proper quantity irrespective of printing environment.

The above object is fulfilled, according to the present invention, by a dampening water feeding method in which densities of detecting patches printed on prints in a first print job are used to control a feed rate of dampening water in a second print job following the first print job, the method comprising:

a density measuring step for measuring the densities of the detecting patches on the prints obtained from the first print job;

a feed rate calculating step for calculating a feed rate of the dampening water from the densities of the detecting patches measured in the density measuring step;

a base feed rate calculating step for calculating a base feed rate of the dampening water based on the feed rate obtained in the feed rate calculating step and on a humidity and a temperature occurring when the first print job is performed;

a proper feed rate calculating step for calculating a proper feed rate of the dampening water based on the base feed rate obtained in the base feed rate calculating step and on a humidity and a temperature occurring when the second print job is performed; and a dampening water feeding step for feeding the dampening water when performing the second print job, based on the proper feed rate obtained in the proper feed rate calculating step.

With this dampening water feeding method, the dampening water may be fed in a proper quantity irrespective of changes in printing environment. This is effective to avoid the wasteful use of printing paper noted hereinbefore.

In a preferred embodiment of the invention, the proper feed rate calculating step is executed to derive the proper feed rate from the following equation:

$$Wt=\alpha\times T+\beta\times H+Wb$$

where Wb is the base feed rate, Wt is the proper feed rate, T is temperature, H is humidity, and $\alpha$ and $\beta$ are coefficients.

In another aspect of the invention, a printing machine is provided in which densities of detecting patches printed on prints in a first print job are used to control a feed rate of dampening water in a second print job following the first print job, the printing machine comprising:

a density measuring device for measuring the densities of the detecting patches on the prints obtained from the first print job;

a feed rate calculating device for calculating a feed rate of the dampening water from the densities of the detecting patches measured by the density measuring device;

a base feed rate calculating device for calculating a base feed rate of the dampening water based on the feed rate obtained by the feed rate calculating device and on a humidity and a temperature occurring when the first print job is performed;

a proper feed rate calculating device for calculating a proper feed rate of the dampening water based on the base feed rate obtained by the base feed rate calculating device and on a humidity and a temperature occurring when the second print job is performed; and a dampening water feeding device for feeding the dampening water when performing the second print job, based on the proper feed rate obtained by the proper feed rate calculating device.

In a further aspect of the invention, a dampening water feeding method is provided in which, based on color densities measured of prints in a first print job, a feed rate of dampening water is controlled in a second print job following the first print job, the method comprising:

a first humidity/temperature measuring step for measuring humidity and/or temperature when the first print job is performed;

a color density measuring step for measuring color densities of a proper print obtained from the first print job;

a feed rate calculating step for calculating a proper feed rate of the dampening water in the first print job from the color densities;

a storing step for storing, as related to each other, the humidity or temperature measured in the first humidity/temperature measuring step and the feed rate of the dampening water calculated in the feed rate calculating step;

a second humidity/temperature measuring step for measuring humidity and/or temperature when the second print job is performed;

a proper feed rate setting step for setting a proper feed rate of the dampening water for the second print job, from the humidity or temperature measured in the second humidity/ temperature measuring step, and based on a relationship between the humidity or temperature and the feed rate of the dampening water stored in the storing step; and a dampening water feeding step for feeding the dampening water when performing the second print job, based on the proper feed rate set in the proper feed rate setting step.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
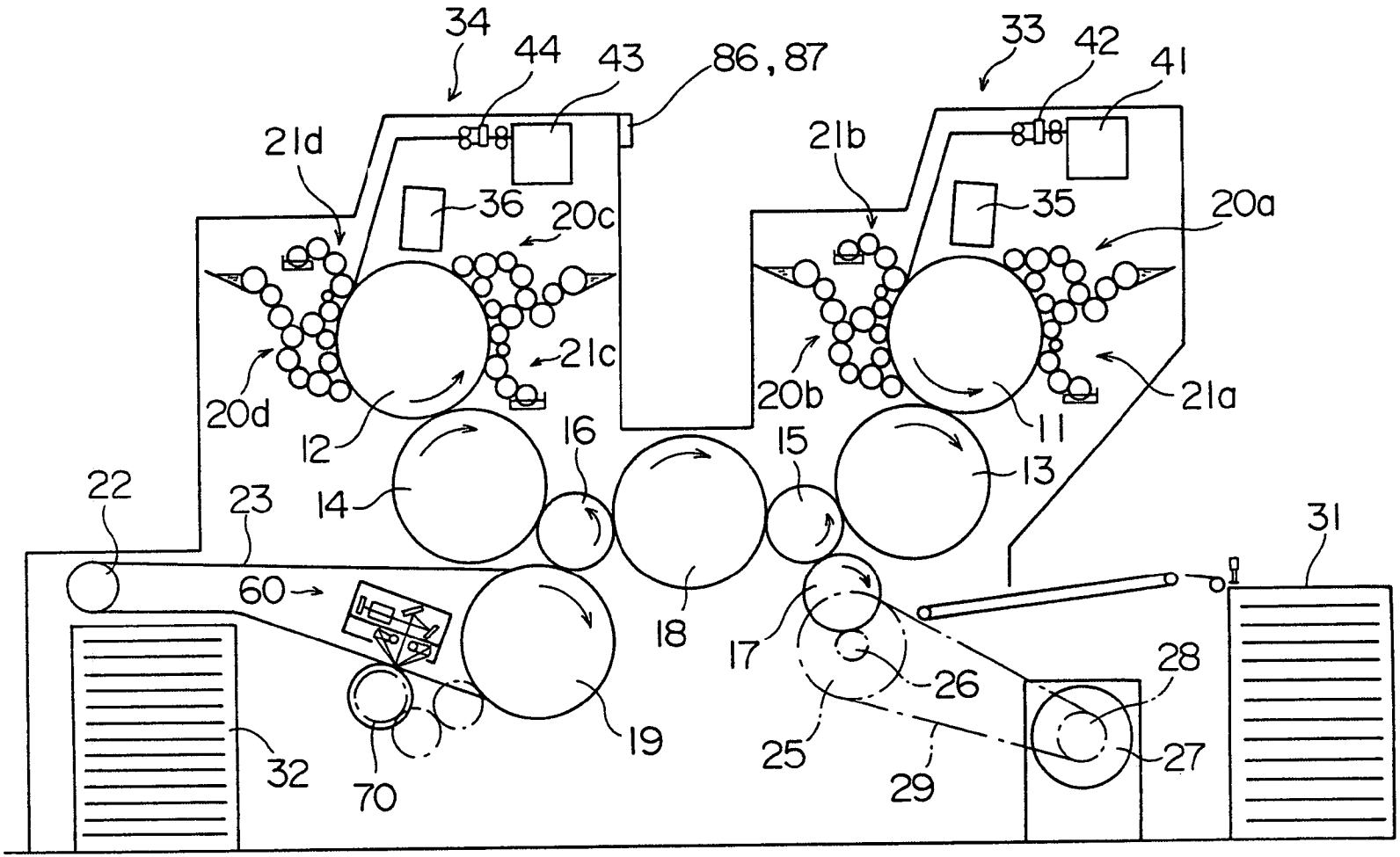
FIG. 1 is a schematic view of a printing machine to which the invention is applied.

An embodiment of this invention will be described hereinafter with reference to the drawings. The construction of a printing machine according to this invention will be described first. FIG. 1 is a schematic view of the printing machine according to this invention.

This printing machine records images on blank plates mounted on first and second plate cylinders 11 and 12 in a prepress process, feeds inks to the plates having the images recorded thereon, and transfers the inks from the plates through first and second blanket cylinders 13 and 14 to printing paper held on first and second impression cylinders 15 and 16, thereby printing the images in four colors on the printing paper.

The printing machine has the first plate cylinder 11, the second plate cylinder 12, the first blanket cylinder 13 contactable with the first plate cylinder 11, the second blanket cylinder 14 contactable with the second plate cylinder 12, the first impression cylinder 15 contactable with the first blanket cylinder 13, and the second impression cylinder 16 contactable with the second blanket cylinder 14. The printing machine further includes a paper feed cylinder 17 for transferring printing paper supplied from a paper storage station 31 to the first impression cylinder 15, a transfer cylinder 18 for transferring the printing paper from the first impression cylinder 15 to the second impression cylinder 16, a paper discharge cylinder 19 with chains 23 wound thereon and extending to and wound on sprockets 22 for discharging printed paper from the second impression cylinder 16 to a paper discharge station 32, and an image pickup station 60 for measuring densities of detecting patches printed on the printing paper.

Each of the first and second plate cylinders 11 and 12 is what is called a two-segmented cylinder for holding two printing plates peripherally thereof for printing in two different colors. The first and second blanket cylinders 13 and 14 have the same diameter as the first and second plate cylinders 11 and 12, and each has blanket surfaces for transferring images in two colors.

The first and second impression cylinders 15 and 16 movable into contact with the first and second blanket cylinders 13 and 14, respectively, have half the diameter of the first and second plate cylinders 11 and 12 and the first and second blanket cylinders 13 and 14. The first and second impression cylinders 15 and 16 have grippers, not shown, for holding and transporting the forward end of printing paper.

The paper feed cylinder 17 disposed adjacent the impression cylinder 15 has the same diameter as the first and second impression cylinders 15 and 16. The paper feed cylinder 17 has a gripper, not shown, for holding and transporting, with each intermittent rotation of the feed cylinder 17, the forward end of each sheet of printing paper fed from the paper storage station 31. When the printing paper is transferred from the feed cylinder 17 to the first impression cylinder 15, the gripper of the first impression cylinder 15 holds the forward end of the printing paper which has been held by the gripper of the feed cylinder 17.

The transfer cylinder 18 disposed between the first impression cylinder 15 and second impression cylinder 16 has the same diameter as the first and second plate cylinders 11 and 12 and the first and second blanket cylinders 13 and 14. The transfer cylinder 18 has a gripper, not shown, for holding and transporting the forward end of the printing paper received from the first impression cylinder 15, and transferring the forward end of the printing paper to the gripper of the second impression cylinder 16.

Figure 5:
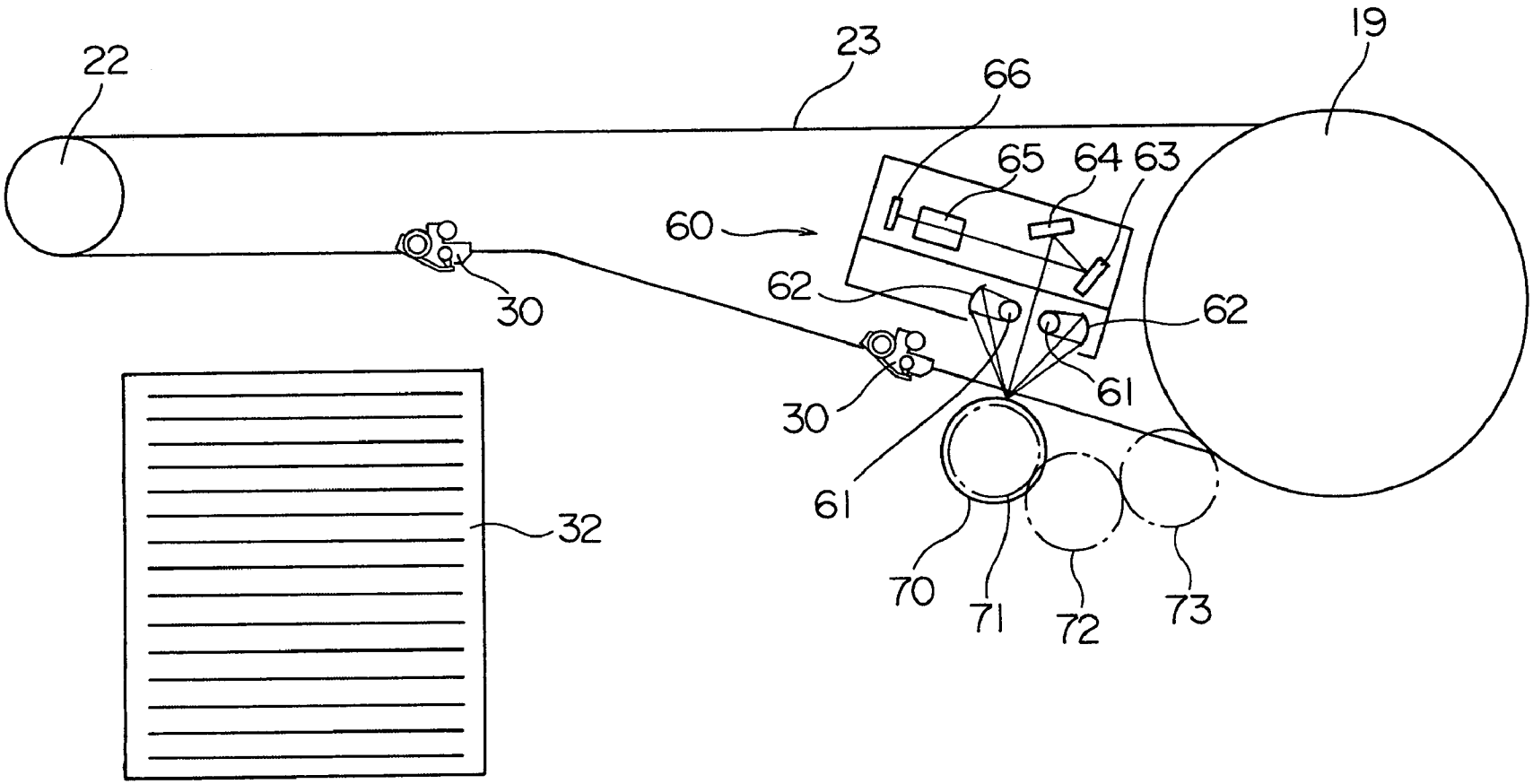
FIG. 5 is a schematic side view showing an image pickup station along with a paper discharge mechanism such as a paper discharge cylinder.

The paper discharge cylinder 19 disposed adjacent the second impression cylinder 16 has the same diameter as the first and second plate cylinders 11 and 12 and the first and second blanket cylinders 13 and 14. The discharge cylinder 19 has a pair of chains 23 wound around opposite ends thereof. The chains 23 are interconnected by coupling members, not shown, having a plurality of grippers 30 arranged thereon (FIG. 5). When the second impression cylinder 16 transfers the printing paper to the discharge cylinder 19, one of the grippers 30 on the discharge cylinder 17 holds the forward end of the printing paper having been held by the gripper of the second impression cylinder 16. With movement of the chains 23, the printing paper is transported to the paper discharge station 32 to be discharged thereon.

The paper feed cylinder 17 has a gear attached to an end thereof and connected to a gear 26 disposed coaxially with a driven pulley 25. A belt 29 is wound around and extends between the driven pulley 25 and a drive pulley 28 rotatable by a motor 27. Thus, the paper feed cylinder 17 is rotatable by drive of the motor 27. The first and second plate cylinders 11 and 12, first and second blanket cylinders 13 and 14, first and second impression cylinders 15 and 16, paper feed cylinder 17, transfer cylinder 18 and paper discharge cylinder 19 are coupled to one another by gears attached to ends thereof, respectively. Thus, by the drive of motor 27, the paper feed cylinder 17, first and second impression cylinders 15 and 16, paper discharge cylinder 19, first and second blanket cylinders 13 and 14, first and second plate cylinders 11 and 12 and transfer cylinder 18 are rotatable synchronously with one another.

The first plate cylinder 11 is surrounded by an ink feeder 20*a* for feeding an ink of black (K), for example, to a plate, an ink feeder 20*b* for feeding an ink of cyan (C), for example, to a plate, and dampening water feeders 21*a* and 21*b* for feeding dampening water to the plates. The second plate cylinder 12 is surrounded by an ink feeder 20*c* for feeding an ink of magenta (M), for example, to a plate, an ink feeder 20*d* for feeding an ink of yellow (Y), for example, to a plate, and dampening water feeders 21*c* and 21*d* for feeding dampening water to the plates.

Further, arranged around the first and second plate cylinders 11 and 12 are a plate feeder 33 for feeding plates to the peripheral surface of the first plate cylinder 11, a plate feeder 34 for feeding plates to the peripheral surface of the second plate cylinder 12, an image recorder 35 for recording images on the plates mounted peripherally of the first plate cylinder 11, and an image recorder 36 for recording images on the plates mounted peripherally of the second plate cylinder 12.

Figure 2:
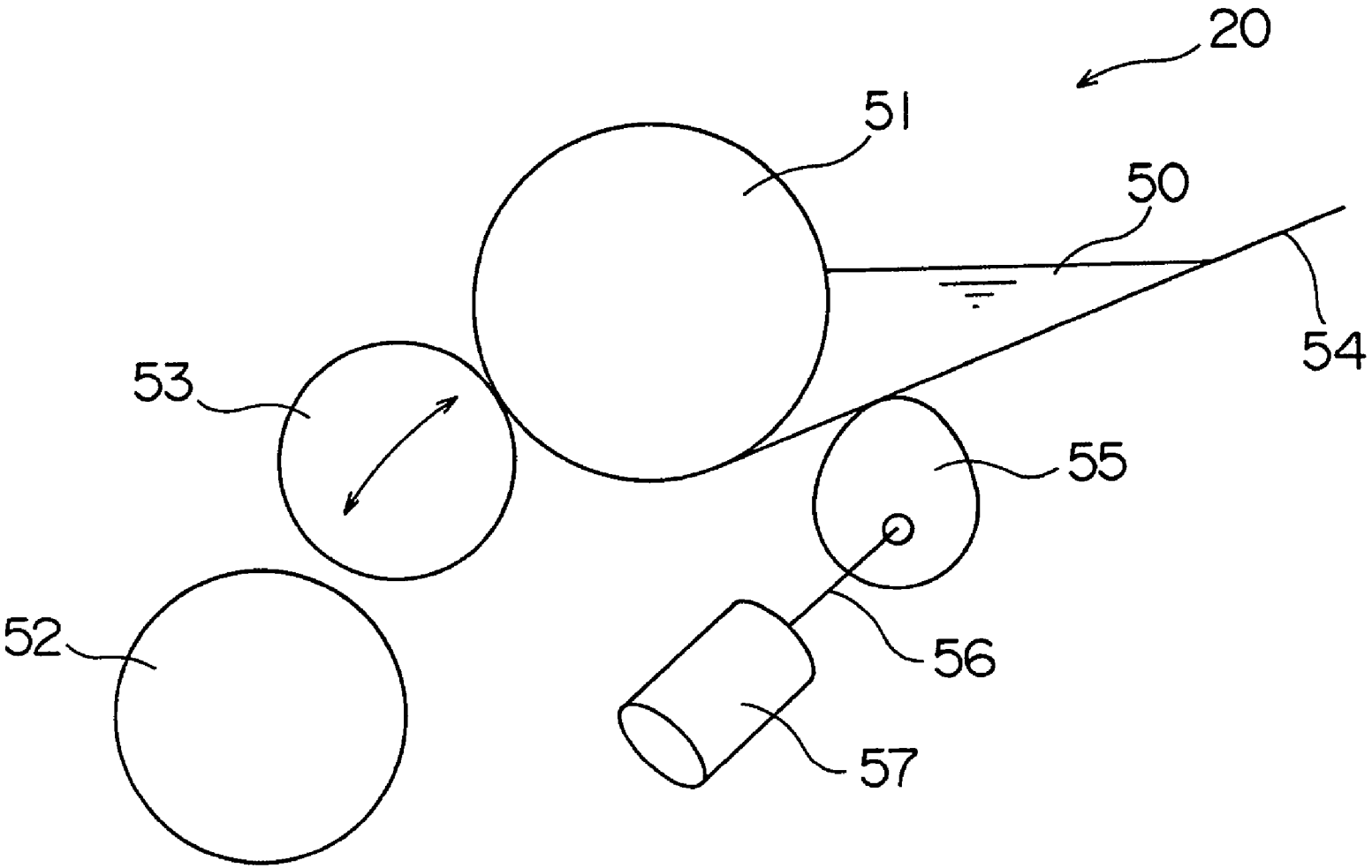
FIG. 2 is a schematic side view of an ink feeder.
Figure 3:
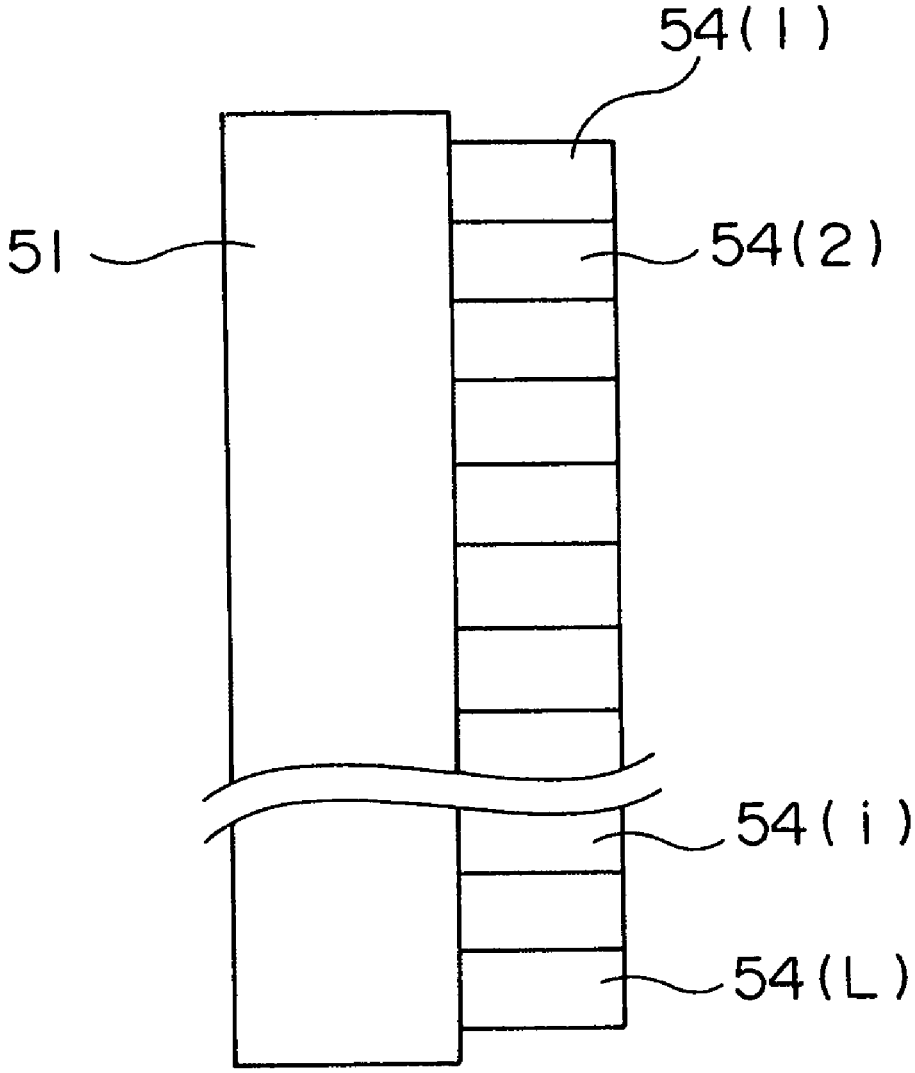
FIG. 3 is a plan view of the ink feeder.

FIG. 2 is a schematic side view of the above ink feeders 20*a*, 20*b*, 20*c* and 20*d* (which may be referred to collectively as "ink feeder 20"). FIG. 3 is a plan view thereof. Ink 50 is omitted from FIG. 3.

The ink feeder 20 includes an ink fountain roller 51 having an axis thereof extending in a direction of width of prints (i.e. perpendicular to a printing direction of the printing machine), and a plurality of ink rollers 52 (only one being shown in FIG. 2), and an ink transfer roller 53 that vibrates between the ink fountain roller 51 and a foremost one of the ink rollers 52. The ink feeder 20 further includes ink keys 54 (1), 54 (2) . . . 54 (L) (which may be referred to collectively as "ink keys 54") arranged in the direction of width of the prints. The ink fountain roller 51 and ink keys 54 define an ink well for storing ink 50.

Eccentric cams 55, L in number, are arranged under the respective ink keys 54 for pressing the ink keys 54 toward the surface of ink fountain roller 51 to vary the opening degree of each ink key 54 with respect to the ink fountain roller 51. The eccentric cams 55 are connected through shafts 56 to pulse motors 57, L in number, for rotating the eccentric cams 55, respectively.

Each pulse motor 57, in response to an ink key drive pulse applied thereto, rotates the eccentric cam 55 about the shaft 56 to vary a pressure applied to the ink key 54. The opening degree of the ink key 54 with respect to the ink fountain roller 51 is thereby varied to vary the rate of ink fed to the printing plate.

Figure 4:
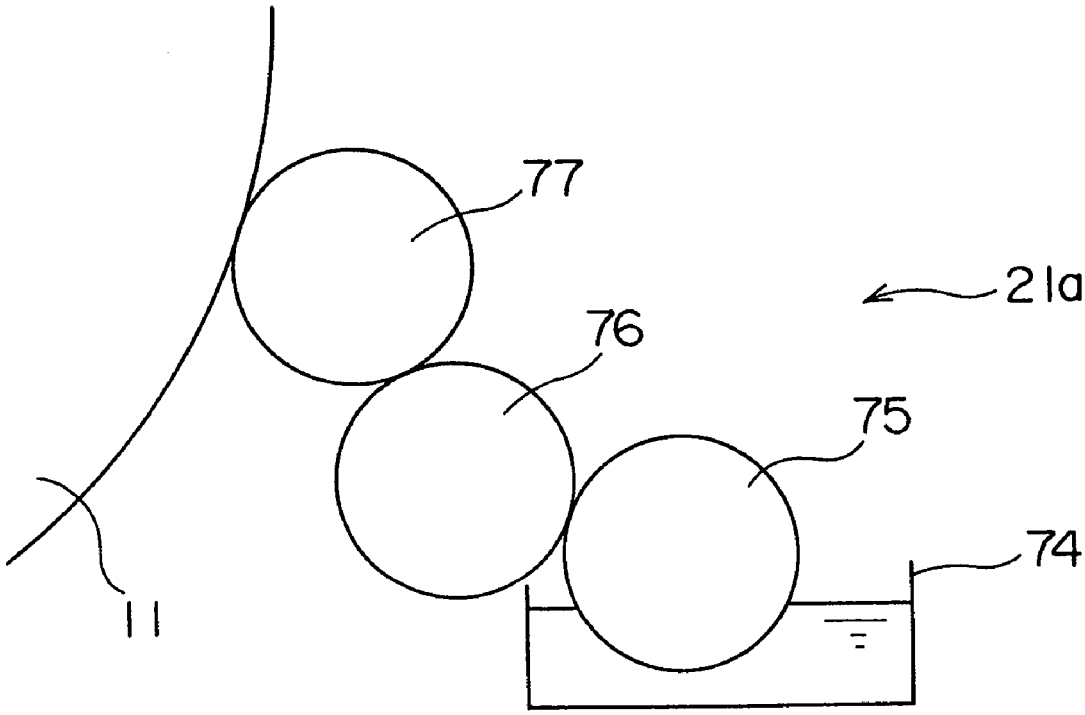
FIG. 4 is a schematic side view of a dampening water feeder.

FIG. 4 is a schematic side view of the dampening water feeder 21*a*.

The dampening water feeder 21*a* includes a water source having a water vessel 74 for storing dampening water and a water fountain roller 75 rotatable by a motor 78, to be described hereinafter, and two water rollers 76 and 77 for transferring the dampening water from the fountain roller 75 to the surface of one of the plates mounted peripherally of the first plate cylinder 11. This dampening water feeder is capable of adjusting the feed rate of dampening water to the surface of the plate by varying the rotating rate of fountain roller 75.

The three other water feeders 21*b*, 21*c* and 21*d* have the same construction as the water feeder 21*a*.

FIG. 5 is a schematic side view showing the image pickup station 60 for measuring densities of detecting patches printed on the printing paper, along with the paper discharge mechanism such as the paper discharge cylinder 19.

The pair of chains 23 are endlessly wound around the opposite ends of the paper discharge cylinder 19 and the pair of sprockets 22. As noted hereinbefore, the chains 23 are interconnected by coupling members, not shown, having a plurality of grippers 30 arranged thereon each for gripping the forward end of printing paper transported. FIG. 5 shows only two grippers 30, with the other grippers 30 omitted.

The pair of chains 23 have a length corresponding to a multiple of the circumference of first and second impression cylinders 15 and 16. The grippers 30 are arranged on the chains 23 at intervals each corresponding to the circumference of first and second impression cylinders 15 and 16. Each gripper 30 is opened and closed by a cam mechanism, not shown, synchronously with the gripper on the paper discharge cylinder 19. Thus, each gripper 30 receives the printing paper from the paper discharge cylinder 19, transports the printing paper with rotation of the chains 23, and is then opened by the cam mechanism, not shown, to discharge the paper on the paper discharge station 32.

The printing paper is transported with only the forward end thereof held by one of the grippers 30, the rear end of printing paper not being fixed. Consequently, the printing paper could flap during transport, which impairs an operation, to be described hereinafter, of the image pickup station 60 to measure densities of the detecting patches. To avoid such an inconvenience, this printing machine provides a suction roller 70 disposed upstream of the paper discharge station 32 for stabilizing the printing paper transported.

The suction roller 70 is in the form of a hollow roller having a surface defining minute suction bores, with the hollow interior thereof connected to a vacuum pump not shown. The suction roller 70 has a gear 71 attached to an end thereof. The gear 71 is connected through idler gears 72 and 73 to the gear attached to an end of the paper discharge cylinder 19. Consequently, the suction roller 43 is driven to rotate in a matching relationship with a moving speed of the grippers 30. Thus, the printing paper is sucked to the surface of the suction roller 70, thereby being held against flapping when passing over the suction roller 70. In place of the suction roller 70, a suction plate may be used to suck the printing paper two-dimensionally.

The above image pickup station 60 includes a pair of linear light sources 61 extending parallel to the suction roller 70 for illuminating the printing paper on the suction roller 70, a pair of condensing plates 62, reflecting mirrors 63 and 64, a condensing lens 65 and a CCD line sensor 66. The detecting patches on the printing paper transported by the paper discharge mechanism including the paper discharge cylinder 19 and chains 23 are illuminated by the pair of linear light sources 61, and photographed by the CCD line sensor 66.

Figure 6:
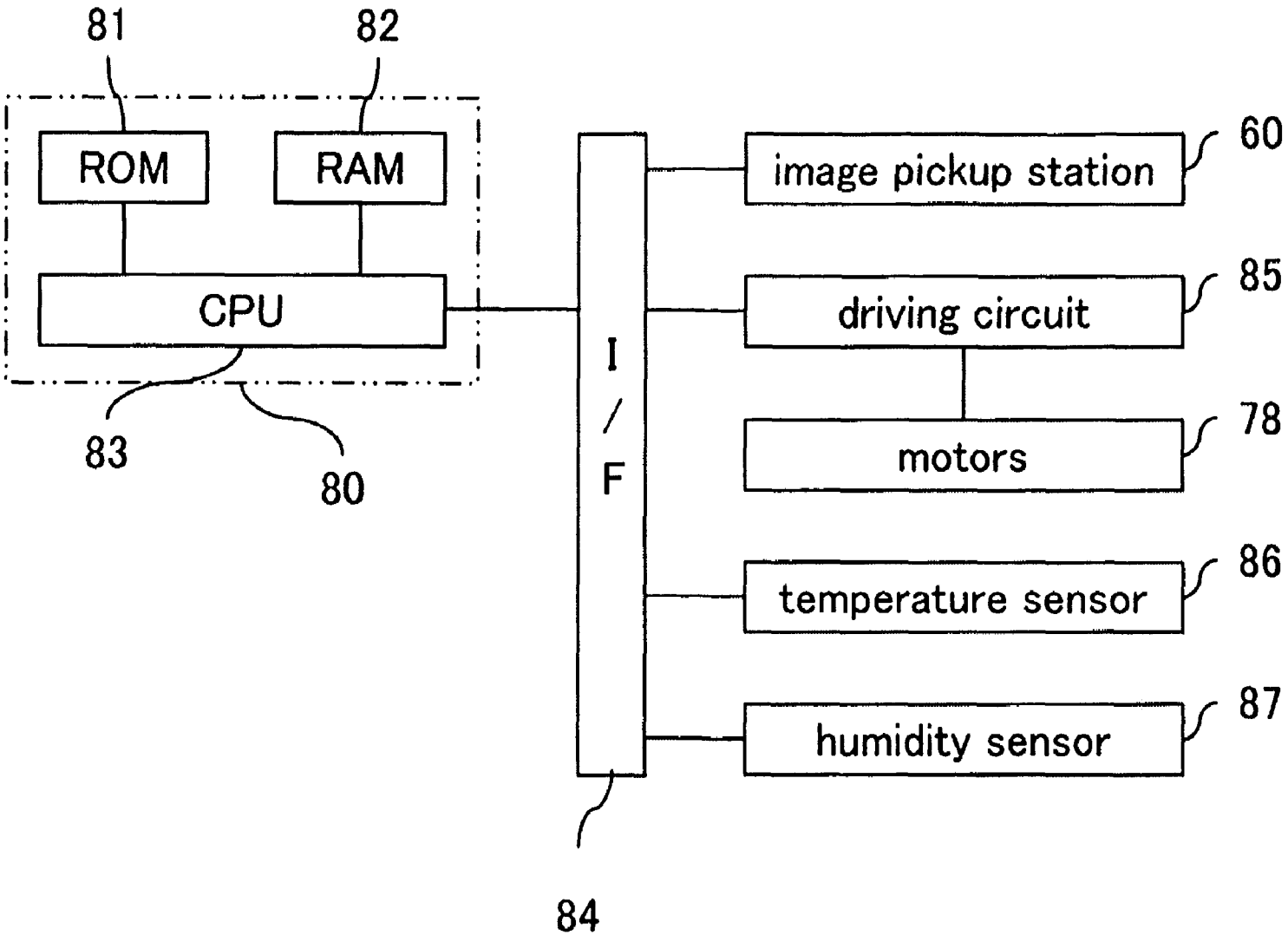
FIG. 6 is a block diagram of a principal electrical structure of the printing machine.

FIG. 6 is a block diagram showing a principal electrical structure of the printing machine. This printing machine includes a control unit 80 having a ROM 81 for storing operating programs necessary for controlling the machine, a RAM 82 for temporarily storing data and the like during a control operation, and a CPU 83 for performing logic operations. The control unit 80 has a driving circuit 85 connected thereto through an interface 84, for generating driving signals for driving the ink feeders 20, dampening water feeders 21, image recorders 35 and 36 and so on. The motor 78 of each dampening water feeder 21 described hereinbefore is connected to the driving circuit 85. The control unit 80 is connected also to the image pickup station 60 through the interface 84. Further, the control unit 80 is connected, through the interface 84, to a temperature sensor 86 and a humidity sensor 87 for determining a printing environment by measurement.

The humidity sensor 86 and temperature sensor 87 may be installed either inside or outside the printing machine. In this embodiment, as shown in FIG. 1, the temperature sensor 86 and humidity sensor 87 are attached to an upper position outside a cover of the printing machine for measuring the ambient temperature and humidity of the printing machine. This reduces the chance of the sensors 86 and 87 being contaminated by ink mist and the like.

The printing machine, under control of the control unit 80, performs a printing operation including a prepress operation and ink and dampening water feeding operations to be described hereinafter. The control unit 80 acts as a base feed rate computing devices for computing a base feed rate Wb described hereinafter, and a proper feed rate computing device for computing a proper feed rate.

In the printing machine having the above construction, a printing plate stock drawn from a supply cassette 41 of the plate feeder 33 is cut to a predetermined size by a cutter 42. The forward end of each plate in cut sheet form is guided by guide rollers and guide members, not shown, and is clamped by clamps of the first plate cylinder 11. Then, the first plate cylinder 11 is driven by a motor, not shown, to rotate at low speed, whereby the plate is wrapped around the peripheral surface of the first plate cylinder 11. The rear end of the plate is clamped by other clamps of the first plate cylinder 11. While, in this state, the first plate cylinder 11 is rotated at low speed, the image recorder 35 irradiates the surface of the plate mounted peripherally of the first plate cylinder 11 with a modulated laser beam for recording an image thereon.

Similarly, a printing plate stock drawn from a supply cassette 43 of the plate feeder 34 is cut to the predetermined size by a cutter 44. The forward end of each plate in cut sheet form is guided by guide rollers and guide members, not shown, and is clamped by clamps of the second plate cylinder 12. Then, the second plate cylinder 12 is driven by a motor, not shown, to rotate at low speed, whereby the plate is wrapped around the peripheral surface of the second plate cylinder 12. The rear end of the plate is clamped by other clamps of the second plate cylinder 12. While, in this state, the second plate cylinder 12 is rotated at low speed, the image recorder 36 irradiates the surface of the plate mounted peripherally of the second plate cylinder 12 with a modulated laser beam for recording an image thereon.

The first plate cylinder 11 has, mounted peripherally thereof, a plate for printing in black ink and a plate for printing in cyan ink. The two plates are arranged in evenly separated positions (i.e. in positions separated from each other by 180 degrees). The image recorder 35 records images on these plates. Similarly, the second plate cylinder 12 has, mounted peripherally thereof, a plate for printing in magenta ink and a plate for printing in yellow ink. The two plates also are arranged in evenly separated positions, and the image recorder 36 records images on these plates, to complete a prepress process.

The prepress process is followed by a printing process for printing the printing paper with the plates mounted on the first and second plate cylinders 11 and 12. This printing process is carried out as follows.

First, each dampening water feeder 21 and each ink feeder 20 are placed in contact with only a corresponding one of the plates mounted on the first and second plate cylinders 11 and 12. Consequently, dampening water and inks are fed to the plates from the corresponding water feeders 21 and ink feeders 20, respectively. These inks are transferred from the plates to the corresponding regions of the first and second blanket cylinders 13 and 14, respectively.

Then, the printing paper is fed to the paper feed cylinder 17. The printing paper is subsequently passed from the paper feed cylinder 17 to the first impression cylinder 15. The impression cylinder 15 having received the printing paper continues to rotate. Since the first impression cylinder 15 has half the diameter of the first plate cylinder 11 and the first blanket cylinder 13, the black ink is transferred to the printing paper wrapped around the first impression cylinder 15 in its first rotation, and the cyan ink in its second rotation.

After the first impression cylinder 15 makes two rotations, the printing paper is passed from the first impression cylinder 15 to the second impression cylinder 16 through the transfer cylinder 18. The second impression cylinder 16 having received the printing paper continues to rotate. Since the second impression cylinder 16 has half the diameter of the second plate cylinder 12 and the second blanket cylinder 14, the magenta ink is transferred to the printing paper wrapped around the second impression cylinder 16 in its first rotation, and the yellow ink in its second rotation.

The forward end of the printing paper printed in the four colors in this way is passed from the second impression cylinder 16 to the paper discharge cylinder 19. The printing paper is transported by the pair of chains 23 toward the paper discharge station 32 to be discharged thereon.

At this time, the detecting patches on the printing paper being transported are illuminated by the pair of linear light sources 61, and are photographed by the CCD line sensor 66.

After the printing process, the printing paper printed is discharged. The first and second blanket cylinders 13 and 14 are cleaned by a blanket cylinder cleaning device, not shown, to complete the printing process.

This printing machine requires an adjustment to be made in advance of a printing operation in order to feed the dampening water in a proper quantity to the printing plates. A dampening water feeding method according to this invention will be described hereinafter.

Figure 7:
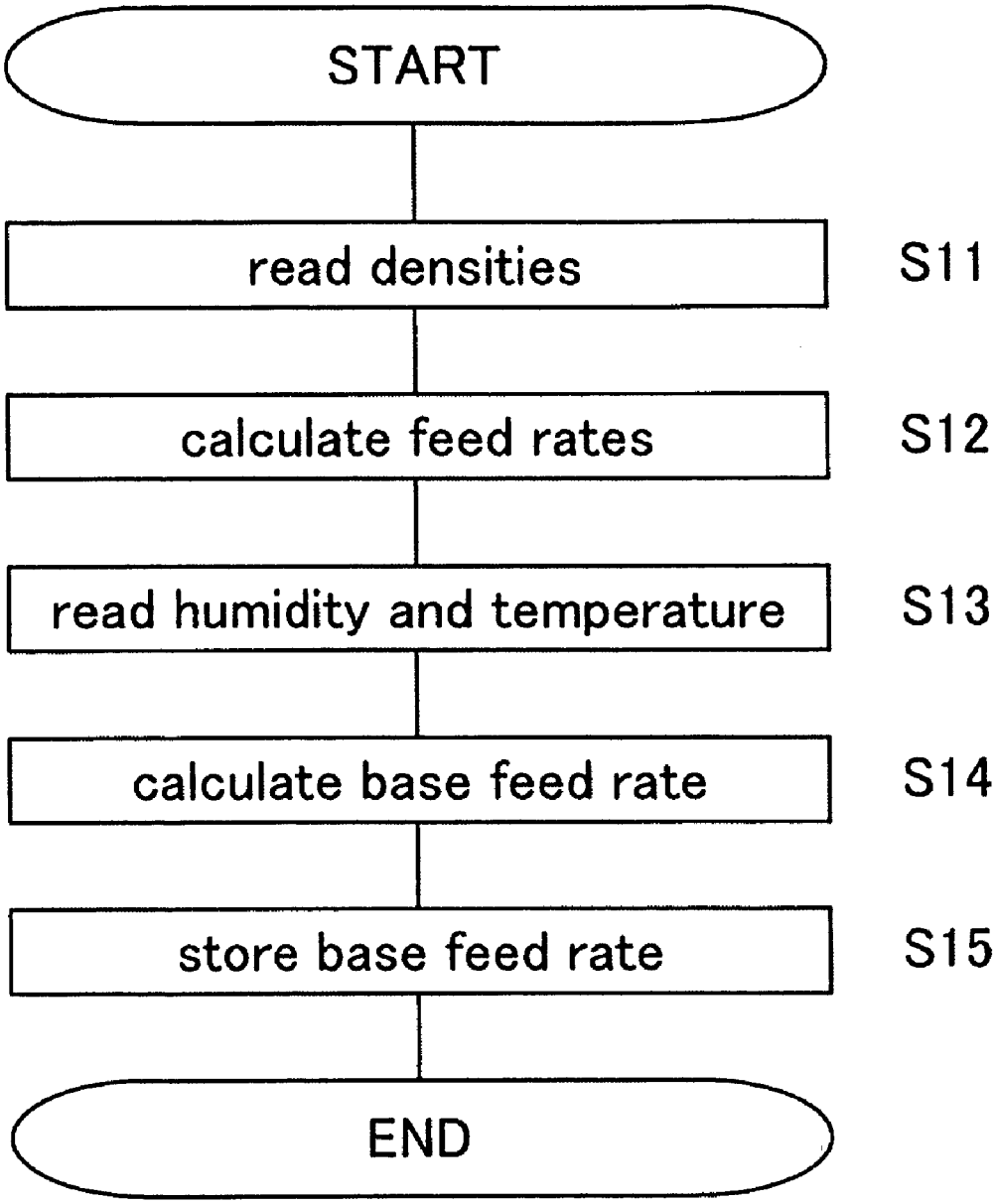
FIG. 7 is a flow chart of an operation for feeding dampening water.
Figure 8:
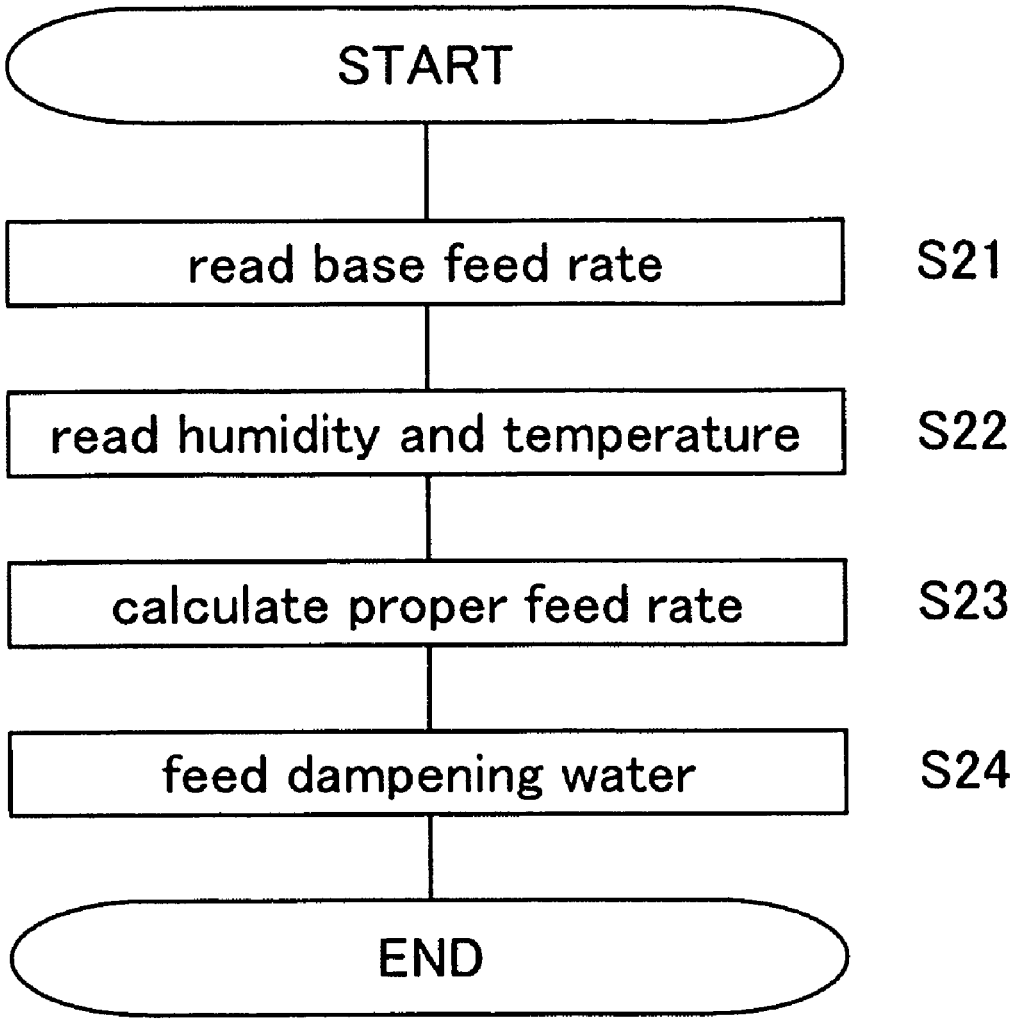
FIG. 8 is another flow chart of the operation for feeding dampening water.

FIGS. 7 and 8 are flow charts showing an operation for feeding the dampening water. FIG. 7 shows an operation relating to a first print job done first. FIG. 8 shows an operation relating to a second print job done after the first printing job. In performing the two print jobs, the operations shown in FIGS. 7 and 8 are carried out continuously.

The dampening water feeding method according to this invention uses the densities of detecting patches also called control scales printed on prints in the first print job, to control the feed rate of dampening water in the second print job following the first print job. Specifically, the dampening water feeding method according to this invention is executed by measuring the densities of the detecting patches on the prints made in the first print job, calculating a feed rate of dampening water from the densities of the detecting patches, calculating a base feed rate of dampening water from the feed rate obtained and the humidity and temperature occurring in time of the first print job, and calculating a proper feed rate of dampening water based on the base feed rate and the humidity and temperature occurring in time of the second print job.

The proper feed rate is calculated by using the following equation:

$$Wt=\alpha\times T+\beta\times H+Wb$$

where Wb is the base feed rate, Wt is the proper feed rate, T is temperature, H is humidity, and α and β are coefficients obtained empirically.

Specifically, when the printing machine performs a print job (first print job), the densities of the detecting patches on the printing paper printed are measured at the image pickup station 60 shown in FIGS. 1 and 5. These measurements are first read for feeding the dampening water (step S11).

Figure 9:
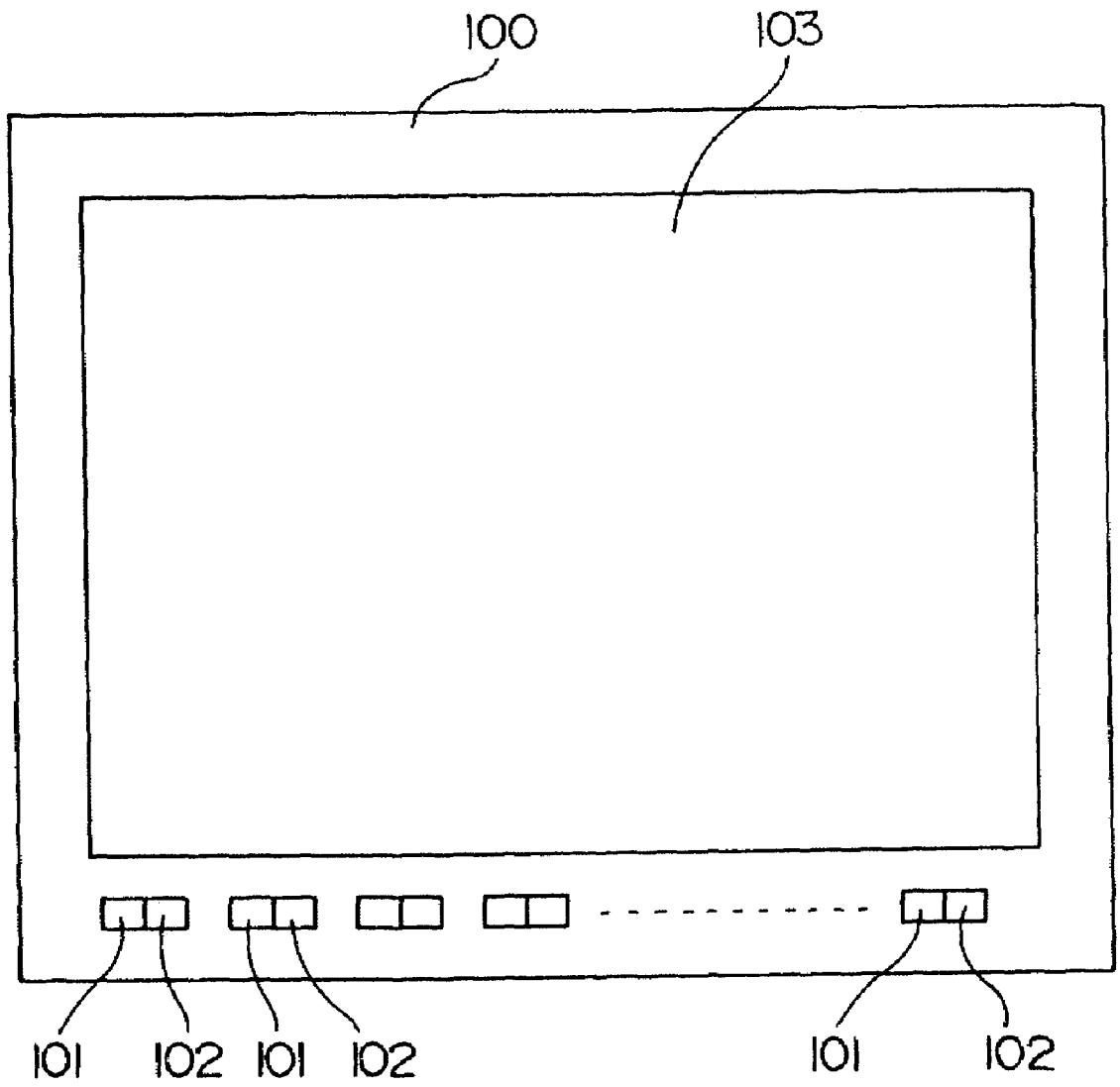
FIG. 9 is an explanatory view of first detecting patches and second detecting patches printed on printing paper as a result of a printing operation.

FIG. 9 is an explanatory view showing first detecting patches 101 and second detecting patches 102 printed on printing paper 100 in a printing process.

These first and second detecting patches 101 and 102 are printed in areas between one end of the printing paper 100 and an end of an image area 103 on the printing paper 100. The first detecting patches 101 and second detecting patches 102 are arranged in discrete, adjacent pairs, L in number corresponding to the number L of areas divided in the direction of width of the print (i.e. perpendicular to the printing direction of the printing machine), as are the ink keys 54 noted hereinbefore.

The first and second detecting patches 101 and 102 used are those patches that show different density variations, after printing, with variations in the feed rates of dampening water and ink. The first detecting patches 101 are solid patches having a large halftone area ratio, for example, while the second detecting patches 102 are line patches having a small halftone area ratio.

Next, a feed rate of dampening water is calculated from the densities of the first and second detecting patches 101 and 102 (step S12). This feed rate of dampening water is determined according to the image data to be printed, the type of printing paper, and so on. This feed rate of dampening water is obtained as described in Japanese Unexamined Patent Publication No. 2002-355950, for example. That is, a preliminary printing step is executed first for making a plurality of prints while varying the feed rates of dampening water and ink, and an expression is determined, by multiple regression analysis, indicating water densities corresponding to variations in the densities of the first and second detecting patches 101 and 102 occurring with variations of the dampening water. Next, a water density is calculated by substituting into the above expression the density of the first detecting patches 101 and the density of the second detecting patches 102 on the prints obtained by trial printing. An amount of ink adjustment $\alpha$ is calculated by using this water density. Each of the feed rates of dampening water and ink is adjusted based on the water density calculated.

Next, temperature T in the room in which the printing machine is installed is read from the temperature sensor 86 shown in FIG. 6, and humidity H in the room from the humidity sensor 87 (step S13).

Next, base feed rate Wb is calculated by substituting the feed rate of dampening water calculated in step S12 for the proper feed rate Wt in the equation noted hereinbefore, and substituting the temperature T and humidity H measured in step S13 for the temperature T and humidity H in the equation noted hereinbefore. This base feed rate Wb is a feed rate of dampening water serving as a basis that disregards the influences of humidity and temperature in time of printing. The base feed rate Wb is stored in the RAM 82 shown in FIG. 6 (step S15).

The base feed rate Wb is a feed rate of dampening water serving as a basis that disregards the influences of humidity and temperature in time of printing as noted above. The base feed rate Wb may vary with other printing conditions (e.g. the type of printing paper and the type of ink). It is therefore desirable to store, in the RAM 82, also such printing conditions other than humidity and temperature as related to the base feed rate Wb. In this case, a proper dampening water feed rate may be determined with increased accuracy by using a base feed rate Wb calculated when the printing conditions are in agreement or similar.

When performing the next print job (second print job), the base feed rate Wb stored in time of the first print job is read first (step S21). Then, the temperature T in the room in which the printing machine is installed is read from the temperature sensor 86 shown in FIG. 6, and humidity H in the room from the humidity sensor 87 (step S22).

Where, as described above, the printing conditions other than humidity and temperature are stored as related to the base feed rate Wb in the RAM 82, the base feed rate Wb calculated beforehand with the printing conditions corresponding to the second print job may be used.

A proper feed rate Wt is calculated by substituting the base feed rate Wb read in step S21 for the base feed rate Wb in the equation noted hereinbefore, and the temperature T and humidity H measured in step S22 for the temperature T and humidity H in that equation.

The proper feed rate Wt thereby obtained is a feed rate of dampening water suited to the printing environment existent at that time. Then, the dampening water is fed by using this proper feed rate Wt (step S24). At this time, the feed rate of dampening water to the surface of each printing plate may be adjusted by the control unit 80 shown in FIG. 6 controlling the motor 78 to vary the rotational frequency of the water fountain roller 75 shown in FIG. 4.

In parallel with the steps shown in FIG. 8 (steps S21 to S24) for the second print job, the steps shown in FIG. 7 (steps S11 to S15) are executed in preparation for a third job to follow.

With the base feed rate Wb determined for each print job as described above, the dampening water may always be supplied in a proper quantity even when the printing environment of the printing machine changes with time.

Coefficients $\alpha$ and $\beta$ described above may be given optimal values by carrying out a printing operation based on the method described in Japanese Unexamined Patent Publication No. 2002-355950 noted hereinbefore, and measuring the humidity and temperature at that time. The measurement for these coefficients $\alpha$ and $\beta$ may be carried out upon completion of every tens of jobs, for example. The feed rate of dampening water changes with time since the water fountain roller 75 and water rollers 76 and 77 shown in FIG. 4 become gradually thinner over an extended period of printing operations. It is therefore desirable to determine and store optimum values of coefficients $\alpha$ and $\beta$ from time to time, and make adjustments accordingly.

Coefficients $\alpha$ and $\beta$ may also be calculated in relation with printing conditions other than humidity and temperature.

In the embodiment described above, a proper feed rate of dampening water is calculated for the second print job based on the base feed rate Wb calculated in the preceding print job (first print job). It is possible to use an appropriate weighted average of data of a plurality of base feed rates Wb calculated in a plurality of first print jobs.

While, in the embodiment described above, the base feed rate Wb in the first print job is stored, a proper feed rate of dampening water in the first print job itself may be stored as related to the temperature and humidity at that time or also to other printing conditions. For example, the density of a print may be measured when the operator determines that its color tone or the like is appropriate, and the feed rate of dampening water at that time may be stored as a proper feed rate and as related to the temperature and humidity occurring at that time, or also to other printing conditions. Instead of relaying on a judgment by the operator, a selection may be made when an automatic control of ink or dampening water is stabilized. In this case, the feed rate of dampening water stored as related to the temperature and humidity or also to other printing conditions in agreement with or similar to those for the second print job may be used as it is.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2003-365637 filed in the Japanese Patent Office on Oct. 27, 2003, the entire disclosure of which is incorporated herein by reference.

What is claimed is:

1. A dampening water feeding method in which densities of detecting patches printed on prints in a first print job are used to control a feed rate of dampening water in a second print job following the first print job, said method comprising:

a density measuring step for measuring the densities of the detecting patches on the prints obtained from the first print job;

a feed rate calculating step for calculating a feed rate of the dampening water from the densities of the detecting patches measured in said density measuring step;

a base feed rate calculating step for calculating a base feed rate of the dampening water based on the feed rate obtained in said feed rate calculating step and on a humidity and a temperature occurring when the first print job is performed;

a proper feed rate calculating step for calculating a proper feed rate of the dampening water based on the base feed rate obtained in said base feed rate calculating step and on a humidity and a temperature occurring when the second print job is performed; and a dampening water feeding step for feeding the dampening water when performing the second print job, based on the proper feed rate obtained in said proper feed rate calculating step.

2. A dampening water feeding method as defined in claim 1, wherein said proper feed rate calculating step is executed to derive the proper feed rate from the following equation:

$$Wt=\alpha\times T+\beta\times H+Wb$$

where Wb is the base feed rate, Wt is the proper feed rate, T is temperature, H is humidity, and α and β are coefficients.

3. A printing machine in which densities of detecting patches printed on prints in a first print job are used to control a feed rate of dampening water in a second print job following the first print job, said printing machine comprising:

density measuring means for measuring the densities of the detecting patches on the prints obtained from the first print job;

feed rate calculating means for calculating a feed rate of the dampening water from the densities of the detecting patches measured by said density measuring means;

base feed rate calculating means for calculating a base feed rate of the dampening water based on the feed rate obtained by said feed rate calculating means and on a humidity and a temperature occurring when the first print job is performed;

proper feed rate calculating means for calculating a proper feed rate of the dampening water based on the base feed rate obtained by said base feed rate calculating means and on a humidity and a temperature occurring when the second print job is performed; and dampening water feeding means for feeding the dampening water when performing the second print job, based on the proper feed rate obtained by said proper feed rate calculating means.

4. A printing machine as defined in claim 3, wherein said proper feed rate calculating means is arranged to derive the proper feed rate from the following equation:

$$Wt=\alpha\times T+\beta\times H+Wb$$

where Wb is the base feed rate, Wt is the proper feed rate, T is temperature, H is humidity, and α and β are coefficients.

5. A dampening water feeding method in which, based on color densities measured of prints in a first print job, a feed rate of dampening water is controlled in a second print job following the first print job, said method comprising:

a first humidity/temperature measuring step for measuring humidity and/or temperature when the first print job is performed;

a color density measuring step for measuring color densities of a proper print obtained from the first print job;

a feed rate calculating step for calculating a proper feed rate of the dampening water in the first print job from said color densities;

a storing step for storing, as related to each other, the humidity or temperature measured in said first humidity/temperature measuring step and the feed rate of the dampening water calculated in said feed rate calculating step;

a second humidity/temperature measuring step for measuring humidity and/or temperature when the second print job is performed;

a proper feed rate setting step for setting a proper feed rate of the dampening water for the second print job, from the humidity or temperature measured in said second humidity/temperature measuring step, and based on a relationship between the humidity or temperature and the feed rate of the dampening water stored in said storing step; and a dampening water feeding step for feeding the dampening water when performing the second print job, based on the proper feed rate set in said proper feed rate setting step.

6. A dampening water feeding method as defined in claim 5, wherein:

said storing step is executed to store also a type of printing paper as related to the feed rate of the dampening water; and said proper quantity setting step is executed to set the proper feed rate of the dampening water based also on a relationship between the type of printing paper and the feed rate of the dampening water stored in said storing step.

7. A dampening water feeding method as defined in claim 5, wherein:

said storing step is executed to store also a type of ink as related to the feed rate of the dampening water; and said proper quantity setting step is executed to set the proper feed rate of the dampening water based also on a relationship between the type of ink and the feed rate of the dampening water stored in said storing step.

8. A printing machine in which, based on color densities measured of prints in a first print job, a feed rate of dampening water is controlled in a second print job following the first print job, said printing machine comprising:

first humidity/temperature measuring means for measuring humidity and/or temperature when the first print job is performed;

color density measuring means for measuring color densities of a proper print obtained from the first print job;

feed rate calculating means for calculating a proper feed rate of the dampening water in the first print job from said color densities;

storage means for storing, as related to each other, the humidity or temperature measured by said first humidity/temperature measuring means and the feed rate of the dampening water calculated by said feed rate calculating means;

second humidity/temperature measuring means for measuring humidity and/or temperature when the second print job is performed;

proper feed rate setting means for setting a proper feed rate of the dampening water for the second print job, from the humidity or temperature measured by said second humidity/temperature measuring means, and based on a relationship between the humidity or temperature and the feed rate of the dampening water stored in said storage means; and a dampening water feeding means for feeding the dampening water when performing the second print job, based on the proper feed rate set by said proper feed rate setting means.

9. A printing machine as defined in claim 8, wherein:

said storage means is arranged to store also a type of printing paper as related to the feed rate of the dampening water; and said proper quantity setting means is arranged to set the proper feed rate of the dampening water based also on a relationship between the type of printing paper and the feed rate of the dampening water stored in said storage means.

10. A printing machine as defined in claim 8, wherein:

said storage means is arranged to store also a type of ink as related to the feed rate of the dampening water; and said proper quantity setting means is arranged to set the proper feed rate of the dampening water based also on a relationship between the type of ink and the feed rate of the dampening water stored in said storage means.

* * * * *